United States Patent [19]

Sequeira, Jr. et al.

[11] 4,304,660

[45] Dec. 8, 1981

[54] MANUFACTURE OF REFRIGERATION OILS

[75] Inventors: Avilino Sequeira, Jr., Port Arthur; Ralph P. Chesluk, Nederland; Howard J. Platte, Houston, all of Tex.

[73] Assignee: Texaco Inc., White Plains, N.Y.

[21] Appl. No.: 140,148

[22] Filed: Apr. 14, 1980

[51] Int. Cl.[3] ..... C10G 21/16; C10G 21/20

[52] U.S. Cl. ..... 208/326; 208/320; 208/327; 208/335

[58] Field of Search ..... 208/320, 321, 322, 326, 208/327, 335

[56] References Cited

U.S. PATENT DOCUMENTS

| | | | |
|---|---|---|---|
| 2,079,885 | 5/1937 | Voorhees | 208/320 X |
| 2,106,234 | 1/1938 | Bray | 208/320 X |
| 2,261,287 | 11/1941 | Read | 208/320 X |
| 3,306,849 | 2/1967 | Bozeman, Jr. et al. | 208/314 |
| 4,057,491 | 11/1977 | Bushnell et al. | 208/321 |

OTHER PUBLICATIONS

G. A. Purdy, Petroleum, Copp Clark Publishing Co., 1958, pp. 211-213.

*Primary Examiner*—Delbert E. Gantz
*Assistant Examiner*—William Leader
*Attorney, Agent, or Firm*—Carl G. Ries; Robert A. Kulason; George J. Darsa

[57] ABSTRACT

Lubricating oils suitable for use in refrigeration equipment in admixture with fluorinated hydrocarbon refrigerants are produced by solvent extraction of naphthenic lubricating oil base stocks, cooling the resulting extract mixture, optionally with the addition of a solvent modifier, to form a secondary raffinate and a secondary extract, and recovering a dewaxed oil fraction of lowered pour point from the secondary raffinate as a refrigeration oil product.

The process of the invention obviates the need for a separate dewaxing operation, such as dewaxing with urea, as conventionally employed for the production of refrigeration oils.

14 Claims, 1 Drawing Figure

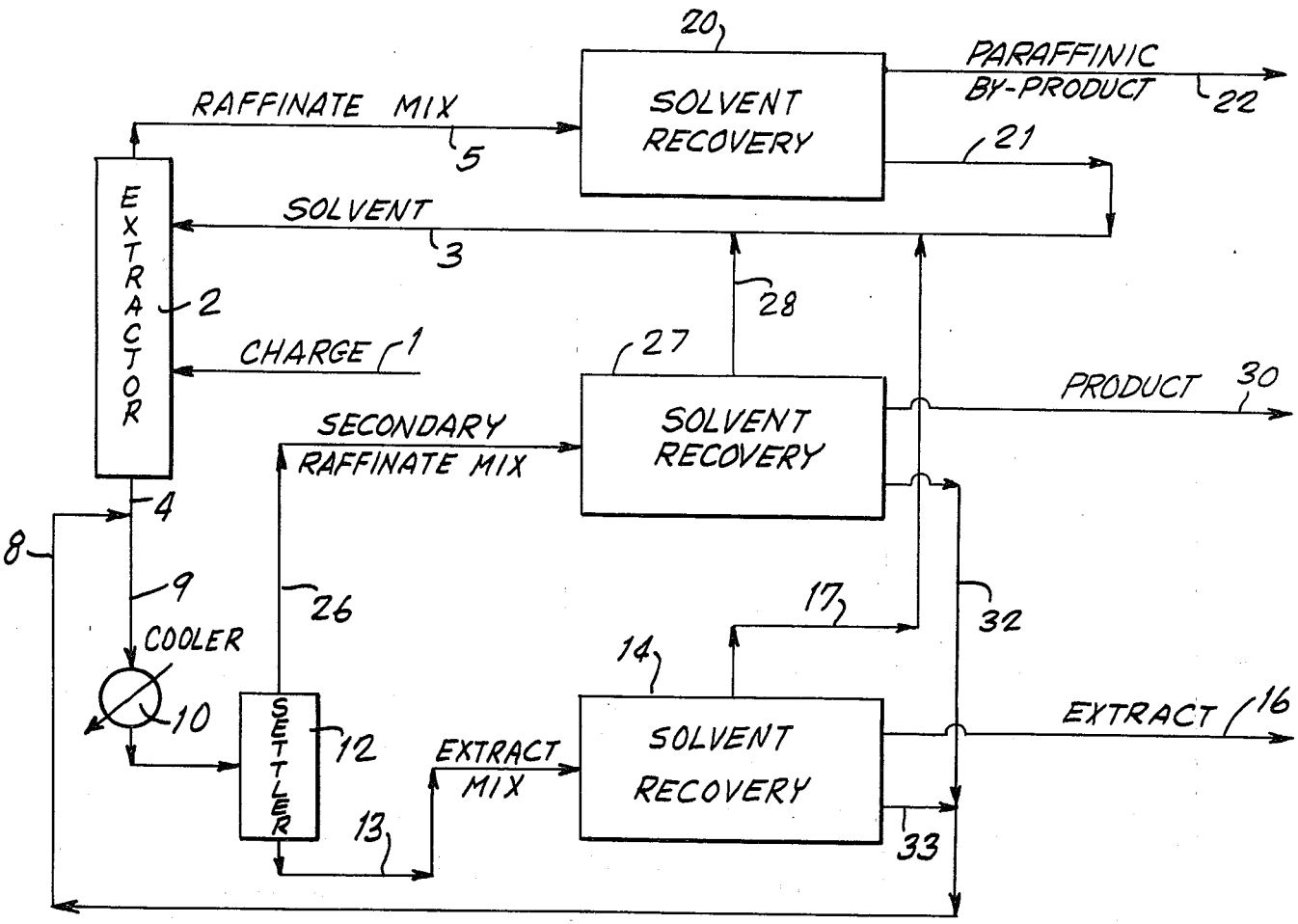
PARAFFINIC BY-PRODUCT
22
21
PRODUCT
30
EXTRACT
16
32
33
17
SOLVENT RECOVERY
20
28
SOLVENT RECOVERY
27
SOLVENT RECOVERY
14
RAFFINATE MIX
5
SOLVENT
3
CHARGE
1
SECONDARY RAFFINATE MIX
EXTRACT MIX
13
12
26
SETTLER
EXTRACTOR
2
4
9
COOLER
10
8

MANUFACTURE OF REFRIGERATION OILS

The invention relates to an improved process for the preparation of refrigeration oils from naphthenic petroleum oil feedstocks containing aromatic, naphthenic, and paraffinic constituents. In one of its more specific aspects, the invention relates to an improved method for the preparation of an improved specialty oil or refrigeration oil from the extract fraction obtained on solvent refining of a naphthenic base lubricating oil feedstock. Considerable savings in energy and capital costs may be realized by the process of this invention as compared with conventional processes which produce refrigeration oils by separation of a selected fraction from the raffinates from lubricating oil solvent refining processes and subject the selected fraction to a dewaxing operation.

It is well known that aromatic and unsaturated components of a lubricating oil base stock, such as those derived from crude petroleum by vacuum distillation or distillation residues, may be separated from the more saturated hydrocarbon constituents of the mixture by various processes involving solvent extraction of the unsaturated and aromatic hydrocarbon constituents contained in the base stock. Foremost among the separations processes which have received commercial acceptance are extraction with furfural, N-methyl-2-pyrrolidone, and phenol as solvents.

The removal of aromatics and other undesirable constituents from lubricating oil base stocks improves the viscosity index, color, oxidative stability, thermal stability, and inhibition response of the base oils and of the ultimate lubricating oil products.

In a typical conventional solvent refining process, a suitable petroleum base lubricating oil feedstock is contacted with a selective solvent for aromatic constituents of said feedstock, e.g., furfural or N-methyl-2-pyrrolidone, in an extraction tower wherein two phases are formed, a raffinate phase comprising the more paraffinic constituents of the feedstock, together with a minor amount of solvent and an extract phase comprising the aromatic constituents of the feedstock, together with a major amount of the solvent. The raffinate mixture is separated from the extract mixture in the extraction tower, and solvent is removed from each of these mixtures by fractional distillation processes, for example flash vaporization, distillation, rectification, stripping, or a combination of these operations.

It has been proposed heretofore to further process the raffinate mixture, after separation from the extract phase, for the production of refrigeration oils by subjecting the raffinate, either before or after separation of solvent therefrom, to further solvent extraction. In recent years, there has been an increased demand for low cost thermally stable refrigeration oils with enhanced Freon® solubility characteristics. The raffinate fraction from lubricating oil refining processes has been utilized as one source of low cost feedstock for the production of refrigeration oils.

A refrigeration oil must have an exceptionally low wax content and high thermal and chemical stability. In the prior art processes, refrigeration oil is produced by deep dewaxing, usually by a urea dewaxing process, of primary raffinate obtained by solvent extraction of a naphthenic base stock. The process of this invention eliminates the need for a dewaxing process step. In the process of this invention, the refrigeration oil is produced as a secondary raffinate separated from the primary extract obtained by solvent extracting a naphthenic base stock. Wax contained in the base stock is removed with the primary raffinate while the unstable constituents of the base stock are removed with the secondary extract.

The process of this invention involves the separation of a primary extract from a solvent refining process into two fractions, one relatively richer in aromatic hydrocarbons than the primary extract and the other relatively poorer in aromatic hydrocarbons than the primary extract. It has been found that the unstable constituents of the base stock are retained in the fraction relatively richer in aromatic compounds and that the waxy (paraffinic) compounds are rejected into the primary raffinate. These materials are undesirable as refrigeration oil stock. The fraction relatively poorer in aromatic compounds is a high quality, dewaxed refrigeration oil stock which requires minimal processing steps to produce a superior quality product. The process of the invention, described in greater detail hereinafter, represents an improvement over those of the prior art wherein refrigeration oils are produced by multiple solvent extraction processes.

In the improved refrigeration oil manufacturing process of this invention, preferred charge stocks are distillate, fractions derived from naphthenic base crude oils and is applicable to distillate feedstocks which have been processed by hydrogenation, hydrocracking, acid treating, and the like. The solvent extraction step is carried out under conditions effective to extract about 35 to 75 volume percent of the charge as an aromatic extract. In this process, the lubricating oil stock is contacted with a solvent, for example furfural, N-methyl-2-pyrrolidone or phenol, at a temperature at least 5° C. and preferably in the range of 5° C. to 12° C. below the temperature of complete miscibility of the lubricating oil charge stock in the solvent.

In the process of this invention, the solvent extraction is preferably carried out at a temperature within the range of 40° to 120° C. (120° to 250° F.). In the process of this invention, the lowest solvent dosage which will effect the desired separation, usually within the range of 100 to 600 volume percent, is preferred. The optimum operating temperature and solvent dosage may be determined for any given charge oil and are highly dependent on the viscosity grade and crude source of the distillate charge stock.

Particularly preferred solvents are furfural and N-methyl-2-pyrrolidone, both of which are effective for the solvent extraction of aromatic components from lubricating oil charge stocks at relatively lower temperatures and lower solvent to oil dosages than most other known solvents. N-methyl-2-pyrrolidone is generally the most preferred solvent because of its chemical stability, high solvent power, low toxicity and its ability to produce refined oils of improved quality.

When furfural is employed as solvent, extraction temperatures within the range of 100° to 110° C. (210° to 230° F.) are preferred. When N-methyl-2-pyrrolidone is employed as solvent, solvent extraction temperatures within the range of 70° to 100° C. (170° to 210° F.) are preferred.

The primary raffinate is separated from a primary extract in the extraction step and both are treated for the recovery of solvent for reuse in the process and for the recovery of a refrigeration oil, a paraffinic oil and an aromatic extract, all substantially free from solvent, as products. Various methods may be employed for the separation and recovery of solvent from the various extract, raffinate and secondary raffinate mixtures, the nature of the recovery system depending to some extent upon the particular solvent employed and whether or not the solvent also contains water as a moderator.

To produce a finished lubricating oil base stock, the primary raffinate may be dewaxed to the desired pour point. The secondary raffinate refrigeration oil stock does not usually require dewaxing treatment. If desired, the oil stock may be subjected to a finishing treatment for color and stability improvement as, for example, mild hydrogenation.

The present invention provides a method of producing a third product from solvent extraction by the separation of the extract mixture from a solvent extraction step into two separate fractions, one a secondary extract, which may be processed in the usual manner for the recovery of solvent and an extract product and the other, a secondary raffinate, which is processed for solvent recovery and the production of a refrigeration oil of improved quality. The process of the present invention results in a low temperature oil of improved properties as compared with similar products produced by separation of naphthenic fractions from primary raffinates. At the same time, the need for separate dewaxing of the product is obviated.

It will be understood that various other processing steps, including acid treating, clay percolation, mild hydrogenation, hydrotreating and catalytic dewaxing, may be employed in combination with the process of this invention. For example, the solvent-free secondary raffinate may be treated with sulfuric acid of 95–99 weight percent strength in an amount within the range of 5 to 40 pounds acid per barrel and caustic neutralized to produce a finished refrigeration oil.

Details of the invention will be evident from the accompanying FIGURE and the following detailed description of a preferred embodiment of the present invention.

The FIGURE is a simplified schematic flow diagram illustrating the process of this invention as applied to a commercial solvent refining operation.

With reference to the FIGURE, a naphthenic base lubricating oil feedstock is introduced through line 1 to an extraction tower 2 where it is intimately countercurrently contacted with solvent entering the upper portion of the extraction tower 2 through line 3. In the extraction tower 2, the lubricating oil feedstock is contacted with a selective solvent, e.g., furfural, N-methyl-2-pyrrolidone or phenol. The solvent extraction tower 2 typically is operated at a pressure in the range of 0 to 100 psig (1 to 8 bar) and preferably in the range of 20 to 50 psig (2.4 to 4.5 bar). A solvent rich primary extract mixture, rich in aromatic components from said feedstock, is withdrawn from the bottom of extraction tower 2 through line 4. A primary raffinate mixture, relatively lean in solvent and rich in paraffinic components from said feedstock, is discharged from the upper end of extraction tower 2 through line 5 and processed for the recovery of refined lubricating oil base stock by separation from the solvent as described hereinafter.

The resulting primary extract, containing the major portion of the solvent, is withdrawn from the bottom of extraction tower 2 through line 4, mixed with a solvent modifier, i.e., water, wet solvent, or a light hydrocarbon as described hereinafter, from line 8 and the mixture passed through line 9 to a cooler 10 wherein the primary extract mixture is cooled to a temperature sufficiently lower than the temperature in extraction tower 2 to form two immiscible liquid phases. The cooled extract is passed through line 11 into decanter 12 wherein separation of the two phases occurs. Cooling of the primary extract from extraction tower 2 to a temperature below the temperature existing at the bottom of the extraction tower results in the formation of two liquid phases which are separated from one another by gravity in decanter 12. One of the liquid phases, a secondary extract, is relatively richer in aromatic hydrocarbons than the primary extract withdrawn from the extraction tower, and the other, a secondary raffinate, is relatively poorer in aromatic hydrocarbons than the primary extract.

The quantity of secondary raffinate produced depends upon a number of factors including the solvent-to-oil ratio in the extraction tower 2, the temperature at the outlet of the extraction tower, the character and composition of the solvent, the character and composition of the feedstock, the amount and nature of the solvent modifier and the temperature to which the primary extract is reduced prior to separation of secondary raffinate from a secondary extract. The preferred separation temperature generally is within the range of 35° to 45° C. (95° to 110° F.).

A secondary extract phase is withdrawn from the lower part of decanter 12 and passed through line 13 to solvent recovery system 14, which may be of conventional design, wherein solvent is separated from the extract.

The solvent recovery system may comprise a conventional combination of flash towers and a stripper, not illustrated in the drawing, or any other suitable processing equipment, for example, the solvent recovery system disclosed in U.S. Pat. No. 3,476,681 incorporated herein by reference. Product extract is discharged from the system through line 16 while recovered solvent is passed through line 17 to line 3 and extraction tower 2 for reuse in the process.

Primary raffinate from the top of extraction tower 2 is passed through line 5 to a raffinate recovery system 20 wherein a paraffinic product is recovered from solvent in any suitable manner, for example by washing the raffinate with water or by a combination of flash vaporization and stripping, not illustrated in the drawing. Various methods of separation of solvent from raffinate are well known in the art.

Solvent separated from the primary raffinate in raffinate recovery system 20 is passed through line 21 to line 3 and extraction tower 2 for reuse in the process. The recovered primary raffinate is discharged through line 22 as a paraffinic solvent refined oil product of the process.

The secondary raffinate mixture from the upper part of decanter 12 is passed through line 26 to solvent recovery system 27 as commonly used for solvent recovery in conventional commercial solvent refining operations, wherein solvent is separated from raffinate mixtures.

Solvent separated from the secondary raffinate in solvent recovery system 27 is passed through line 28 and through line 3 to extraction tower 2 for reuse in the process.

The secondary raffinate, a principal product of the process of this invention, is discharged through line 30.

Solvent modifier, i.e. water, wet solvent, or light hydrocarbon, employed in the process is recovered from the secondary raffinate in solvent recovery system 27 and from the secondary extract in solvent recovery system 14. The solvent modifier from solvent recovery system 27 is passed through lines 32 and 8 to line 4 while that from solvent recovery system 14 is returned to line 4 via lines 33 and 8.

Paraffinic distillates of relatively narrow boiling range, e.g., 300° to 350° F., are preferred as light hydrocarbon solvent modifiers for use in the process of this invention. As one specific example of a preferred light hydrocarbon solvent modifier, a heavy raffinate distillate having the following typical test properties may be used:

| | |
|---|---|
| API Gravity, °API | 59.0 |
| Kinematic Viscosity* | 0.86 |
| Carbon Residue, 10% Bottoms | 0.01 |
| Sulfur, Wt. % | 0.002 |
| FIA Analysis, Vol. % | |
| Aromatics | 3.5 |
| Olefins | 3.1 |
| Aniline Point, °F. | 160.5 |
| ASTM Distillation, Vol. % | |
| IBP | 309 |
| 10 | 311 |
| 50 | 317 |
| 90 | 324 |
| EP | 341 |

*Centistokes at 100° F.

A preferred embodiment of the process of this invention and its advantages is illustrated in the following examples.

EXAMPLE 1

A 300 Pale stock was furfural refined at 97° C. (207° F.) with a 400 percent solvent to oil dosage, i.e., four volumes of furfural per volume of feedstock. The extract mixture was cooled to 43° C. (110° F.) and admixed with 10 volume percent water. Under these operating conditions, the primary raffinate yield amounted to 29 volume percent of the charge stock, the secondary raffinate, 64 percent, and the secondary extract, 7 percent. A secondary raffinate was separated from the resulting two phases so formed and subjected to acid treating, caustic neutralization, water washing and brightening. Part of the secondary raffinate was treated with 24 pounds per barrel of 98 percent sulfuric acid and part, with 34 pounds per barrel. Results are shown in Table I.

TABLE I

| | Feed-stock | Raffinates | | Acid-Treated S.R. | |
|---|---|---|---|---|---|
| | | Primary | Secondary | 24 lb. | 34 lb. |
| Color, Lov* | 360 | 25 | 340 | 45 | 35 |
| Aniline Point, °F. | 164 | 220+ | 159 | 160 | 164 |
| Gravity, °API | 20.6 | 30.9 | 20.6 | 22.1 | 22.0 |
| Viscosity | | | | | |
| SUS at 100° F. | 327 | 178.6 | 346 | 333 | 328 |
| SUS at 210° F. | 47.4 | 44.3 | 48.0 | 47.7 | 47.6 |
| Neut. No. | 0.12 | 0.02 | 0.03 | 0.05 | 0.05 |
| Pour, °F. | −25 | −20 | | −35 | −30 |
| Freon Haze, °F. | −20 | — | — | −60 | −40 |
| Freon Floc, °F. | −30 | — | — | −75 | −55 |
| Sulfur, X-ray, % | 0.26 | 0.031 | 0.24 | 0.16 | 0.14 |

*Lovibond 6"

EXAMPLE 2

As bases for comparison, the physical properties of two conventionally processed 300 pale oil stocks and one commercial refrigeration oil product were determined. Samples 1 and 2 of Table II are furfural refined fractions obtained by conventional solvent refining processing of distillate fractions from naphthenic base crude oils. These 300 pale oil stocks may be further processed by acid treating, urea dewaxing and clay percolation to manufacture commercial "300 Pale Oil C". Sample 3 is a commercial refrigeration oil finished product marketed under the trade name "Capella Oil". Refrigeration oils are conventionally produced by distillation of the base stock, e.g. naphthenic crude oil, to obtain a feedstock of the desired viscosity grade, 80–500 SUS/100; furfural extraction to remove some aromatics, sulfur and nitrogen compounds and other undefined undesirable components; treating with sulfuric acid to remove the more easily oxidizable components; urea dewaxing to improve Freon haze and floc, low temperature properties; and clay percolation to improve finished product performance in bench tests and service. Results of tests on these products are shown in Table II.

TABLE II

| Sample Number | 1 | 2 | 3 |
|---|---|---|---|
| Color, Lovibond 6" | — | 50 | 60 |
| Aniline Point, °F. | 187 | 197 | 197 |
| Gravity, °API | 24.5 | 25.4 | 25.3 |
| Viscosity | | | |
| SUS at 100° F. | 309 | 307 | 313 |
| SUS at 210° F. | 48.5 | 48.2 | 47.2 |
| Neut. No. | 0.02 | 0.02 | 0.02 |
| Pour, °F. | −30 | −30 | −35 |
| Freon Haze, °F. | −20+ | −20 | −55 |
| Freon Floc, °F. | — | — | −70 |
| Sulfur, X-ray, % | 0.08 | — | 0.11 |

The comparative data in Tables I and II show that the process of this invention is capable of producing products having reduced Freon Haze and Freon Floc points and that urea dewaxing can be eliminated as a process step in the manufacture of naphthene refrigeration oils. The lower aniline points of the secondary raffinates (Table I) as compared with conventionally processed base stock (Table II) indicates that the refrigeration oils produced by this process have better Freon/oil solubility characteristics than oils produced by the conventional processes.

We claim:

1. A method for the production of refrigeration oil having low pour point and low Freon Haze and Freon Flock properties which comprises contacting a low pour point lubricating oil feed stock distillate from a naphthenic base crude oil with a selective solvent for aromatics in an extraction zone forming a solvent-rich primary extract phase containing the more aromatic and naphthenic components of said lubricating oil feedstock together with a major portion of said solvent and a solvent-poor primary raffinate mixture comprising paraffinic components of said feedstock together with a minor portion of said solvent, withdrawing said solvent rich primary extract phase from said extraction step, cooling said primary extract phase to a temperature within the range of 5° C. to 50° C. below the temperature in said solvent extraction zone whereby two separate liquid phases are produced comprising an aromatics-rich secondary extract phase and an aromatics-lean secondary raffinate phase substantially free from waxy components of said feedstock, recovering said aromatics lean secondary raffinate, separating solvent from said secondary raffinate, and treating solvent-free secondary raffinate with sulfuric acid of 95 to 99 weight percent strength in an amount within the range of 5 to 40 pounds acid per barrel of said raffinate, and recovering unreacted secondary raffinate as a low temperature refrigeration oil have an improved pour point and improved aniline number characteristics as compared with said feedstock.

2. A process according to claim 1 wherein the solvent extraction is carried out at a temperature within the range of 5° C. to 30° C. below the temperature of complete miscibility of said solvent and said stock.

3. A process according to claim 1 wherein said solvent is supplied to said extraction in an amount within the range of 100 to 400 volume percent based on the volume of the naphthenic feedstock.

4. A process according to claim 1 wherein a solvent modifier is admixed with said primary extract prior to cooling.

5. A process according to claim 4 wherein said solvent modifier is water or wet solvent.

6. A process according to claim 4 wherein said solvent modifier is a light hydrocarbon.

7. A process according to either of claims 5 or 6 wherein said modifier comprises from one to ten percent by volume based on the volume of said primary extract.

8. A process according to claim 1 wherein said solvent is furfural.

9. A process according to claim 1 wherein said solvent in N-methyl-2-pyrrolidone.

10. A process according to claim 1 wherein said solvent is phenol.

11. A process according to claim 8 wherein said extraction temperature is within the range of 100° to 110° C.

12. A process according to claim 9 wherein said extraction temperature is within the range of 70° to 100° C.

13. A process according to claim 10 wherein said extraction temperature is within the range of 80° to 110° C.

14. A process according to claim 1 wherein said solvent extraction is carried out at a temperature within the range of 40° to 120° C.

* * * * *